US008893672B2

(12) United States Patent
Allen

(10) Patent No.: US 8,893,672 B2
(45) Date of Patent: Nov. 25, 2014

(54) INTERNAL-COMBUSTION ENGINE WITH REDUCED POLLUTANTS

(76) Inventor: Dana R. Allen, Reno, NV (US)

( * ) Notice: Subject to any disclaimer, the term of this patent is extended or adjusted under 35 U.S.C. 154(b) by 1076 days.

(21) Appl. No.: 12/619,592

(22) Filed: Nov. 16, 2009

(65) Prior Publication Data

US 2010/0122676 A1 May 20, 2010

Related U.S. Application Data

(60) Provisional application No. 61/115,076, filed on Nov. 16, 2008.

(51) Int. Cl.

| | |
|---|---|
| ***F02B 33/10*** | (2006.01) |
| ***F02B 33/14*** | (2006.01) |
| ***F02B 33/12*** | (2006.01) |
| ***F02B 33/22*** | (2006.01) |

(52) U.S. Cl.

CPC ..... *F02B 33/22* (2013.01); *F02B 33/12* (2013.01)

USPC ..... 123/73 R; 123/68; 123/65 SP; 123/317; 123/65 R

(58) Field of Classification Search

CPC ..... F02B 33/10–33/12

USPC ..... 123/65 R, 68, 70 R, 317, 73 R, 68 SP

See application file for complete search history.

(56) References Cited

U.S. PATENT DOCUMENTS

| | | | | |
|---|---|---|---|---|
| 3,931,812 | A * | 1/1976 | Ashfield et al. | 123/73 S |
| 4,761,956 | A | 8/1988 | Schatz | |
| 5,476,076 | A * | 12/1995 | Zhou | 123/193.4 |
| 5,657,724 | A | 8/1997 | Brown et al. | |
| 5,730,099 | A | 3/1998 | Gillespie | |
| 6,536,384 | B1 | 3/2003 | Keoppel | |
| 7,198,011 | B2 | 4/2007 | Truong | |
| 7,210,433 | B2 | 5/2007 | Mavinahally et al. | |
| 7,270,110 | B2 | 9/2007 | Keoppel | |
| 2004/0007192 | A1* | 1/2004 | Keoppel | 123/65 R |
| 2004/0244736 | A1 | 12/2004 | Creel | |
| 2007/0164057 | A1* | 7/2007 | Alley | 222/528 |

FOREIGN PATENT DOCUMENTS

EP 1207291 B1 5/2002

OTHER PUBLICATIONS

Francisco Palomares Ruiz,"2t sdi", Nov. 2, 2008, https://www.youtube.com/watch?v=NjPkvWqIVjk.

* cited by examiner

*Primary Examiner* — Lindsay Low
*Assistant Examiner* — Kevin Lathers

(57) ABSTRACT

A method and apparatus for pumping an intake charge into an engine is disclosed herein. The fuel-powered engine utilizes a barrier between an intake manifold and a crankcase of the engine to substantially protect the intake charge from contamination by engine crankcase oil, while using the natural pumping action of a reciprocating engine piston to pump the intake charge into the combustion chamber.

21 Claims, 9 Drawing Sheets

VIEW A-A

SECT B-B

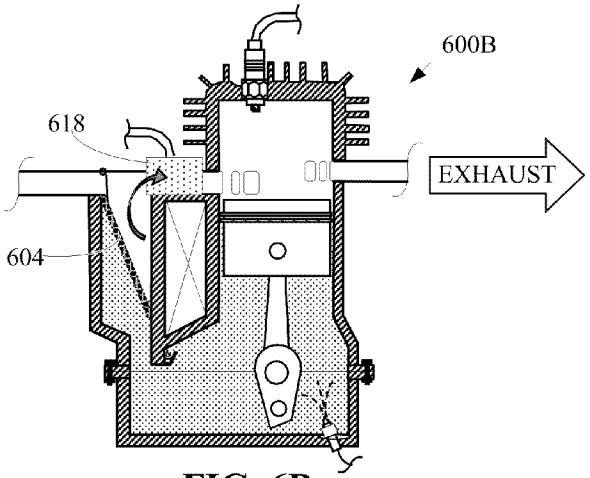
FIG. 6B
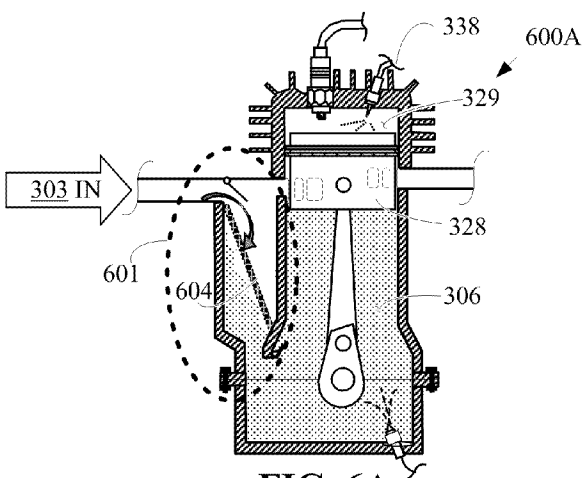
FIG. 6A
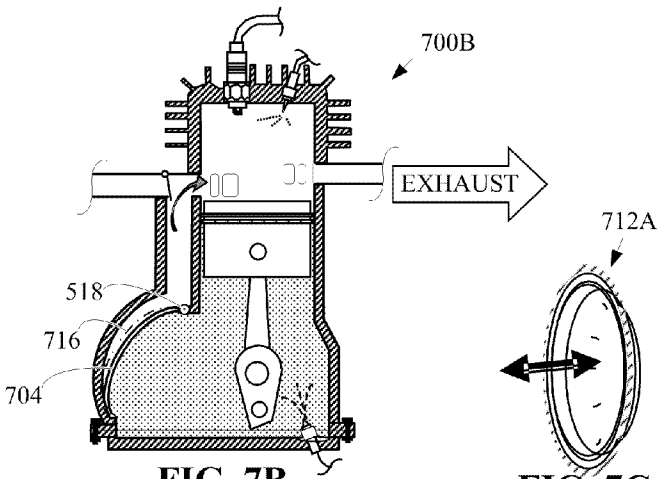
FIG. 7B
FIG. 7C
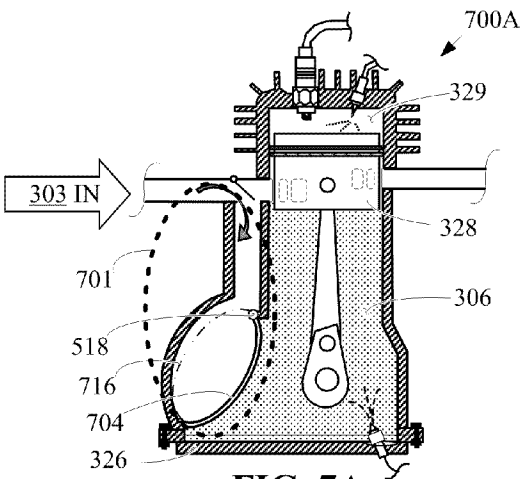
FIG. 7A

INTERNAL-COMBUSTION ENGINE WITH REDUCED POLLUTANTS

REFERENCE TO RELATED APPLICATIONS

This application claims priority to provisional application, Ser. No. 61/115,076, filed Nov. 16, 2008, which application is also incorporated herein by its reference, in its entirety.

BACKGROUND OF THE INVENTION

1. Field of the Invention

The present disclosure relates generally to internal combustion engines and more particularly to two-stroke engines.

2. Description of the Related Art

Internal-combustion engines, e.g., piston engines, fall into two main categories: two-stroke and four-stroke. In general, two-stroke, or two-cycle, engines are much less expensive to manufacture, use less moving parts, produce significantly more power for the same engine displacement, and weigh significantly less. These benefits arise primarily because the two-stroke engine, as compared to the four-stroke engine, generates a power stroke for every one revolution of the crankshaft, rather than every two revolutions of the crankshaft as in the four-stroke engine. The traditional two-stroke engine is a simple and robust design that: uses static cylinder ports rather than a dynamic valve train; lubricates the engine via an oil-laced fuel-air mixture traveling through the crankcase rather than having a separate wet or dry sump crankcase lubrication; and pumps the air-fuel-oil mixture into the cylinder intake using the crankcase pressure rather than 'pulling' it in via natural aspiration or pumping it in via a turbocharger or supercharger.

In a two-stroke engine, each downward stroke of the piston acts as a power stroke. The air-gas-oil mixture is pumped into a cylinder of the engine through an intake port or valve at a sufficient momentum and sufficiently high pressure to help discharge the burned gases from the cylinder through the exhaust port, via a process known as scavenging. A traditional two-stroke engine accomplishes this by pumping the intake charge into the intake using crankcase pressure. That is, the air-fuel-oil mixture is pushed into the lower-pressure crankcase through a valve, e.g., an open reed valve, during an upstroke of the piston, and the intake charge is then pumped out of the crankcase on the down stroke of a piston, when the reed valve is closed.

In order to provide lubrication to the moving parts in the engine, the air or air-fuel mixture is laced with lubricating oil. By adding oil to the air or air-fuel mixture, the crankcase is adequately lubricated. However, several detrimental effects arise from this practice. First, when gas is mixed in with the oil, the lubricating effects of the oil are reduced. Additionally, if the oil is improperly mixed with the gas or is improperly supplied to engine parts, then severe engine damage can arise. Thus a need arises to lubricate the engine without gasoline contamination.

A second detrimental effect of mixing fuel with oil is that oil residue remains in the air or air-fuel mixture as it is burned in the power stroke of the engine thereby producing significant amounts of air and/or water pollution, reducing engine power and fuel efficiency; and creating reliability problems and rough idling arising from an oil-fouled spark plug(s). Air pollution from two-stroke engines is exceptionally noticeable in highly populated developing countries because the engines are inexpensive, and the pollution laws rarely exist or are rarely enforced; a combination that encourages the use and application of two-stroke engines. In fact, in a survey conducted by the Bangladesh Road Transport Authority (BRTA), two-stroke petrol engines were found to be less fuel-efficient, and to emit about 30-100 times more unburned hydrocarbons than four-stroke engines. The inherent pollution from conventional two-stroke gas engines is recognized worldwide as one of the biggest current pollution problems and thus has spurred attempts to outlaw and restrict their use worldwide. Thus, a need arises to overcome the significant drawback of pollution caused by a two-stroke engine application and use.

If a two-stroke engine, utilizes a sealed oil-reserve crankcase, similar to that of a four-stroke engine, then it may not contaminate the air or air-fuel mixture with crankcase oil. However, neither does it utilize the natural pumping from the crankcase to pump the air or air-fuel mixture into the cylinder. Instead it may use a crankshaft-powered Roots type supercharger or an exhaust-powered turbocharger, which can add cost, weight, complexity, and possibly a boost lag. Thus a need arises for a two-stroke engine that both reduces oil pollution and uses crankcase pressure to pump the intake charge.

If an alternative two-stroke engine design utilizes the pumping action of the crankcase to force air or an air-fuel mixture to the combustion chamber but fails to use a barrier, then lubricating oil provided to the crankcase, even if by injector, still has the opportunity of entering the combustion chamber. Thus, a need still exists to provide a two-stroke engine design with substantially reduced oil contamination in the air or air-fuel mixture delivered to the combustion chamber mixture as opposed to reduced oil in the gas mixture on only fuel injected engines.

SUMMARY OF THE INVENTION

The present disclosure of the invention provides a method and apparatus with several embodiments that overcome the limitations of, provide improvements to, and/or satisfy the needs of, internal combustion engines, such as two-stroke engines. In particular, the present disclosure substantially reduces or essentially eliminates contaminants and pollutants, such as lubrication oil, from entering an intake charge, e.g., an air or an air-gas mixture, while still providing lubrication to a crankcase and while efficiently pumping the intake charge into the engine via crankcase pressure instead of costly and complex superchargers or turbochargers. The present invention accomplishes this goal by using a functional barrier, such as a mechanical barrier, a physical barrier, a chemical barrier, or other embodiment, that effectively transmits crankcase pressure to the intake charge but prevents communication of crankcase contaminants from the intake charge. Resultantly, burning of lubricating oil in, and/or emission of contaminants from, the combustion chamber is either substantially reduced or essentially eliminated. The present disclosure has many benefits such as: substantially reducing air and/or water pollution; protecting moving parts in the engine from reduced lubricating oil lubricity and film thickness resulting from fuel presence in the crankcase; reducing spark plug(s) fouling associated with burning two-stroke lubricating oil; and improving performance and fuel economy, all with the ability to be retrofitted to the literally millions of two-stroke engines in use today.

A first embodiment of the present disclosure provides a fuel-powered engine having a cylinder with a port or valve, an engine piston disposed within the cylinder, a crankcase, an intake and an exhaust manifold coupled to the cylinder, and an intake barrier chamber, e.g., a barrier chamber housing, coupled to the intake manifold. The barrier chamber housing provides a reservoir for holding an air or an air/fuel mixture, which will be subsequently pumped into the cylinder for combustion. Pumping action is accomplished using existing engine forces, such as crankcase pressure which is separated from the intake charge by a barrier. Crankcase pressure arises from reciprocating motion of the piston in the cylinder. In the elementary case of a single cylinder engine, an upward moving piston expands the volume of air in the crankcase, while a downward moving piston reduces the volume of air in the crankcase.

The barrier may utilize one of the following designs: a hinged flapper with or without seals; a reciprocating piston with or without rings; a diaphragm; a bellows type bladder; an air permeable but oil blocking filter; a lighter than air gas in a barrier chamber located higher than the crankcase; a heavier than air gas located in the crankcase; a conduit between the crankcase and the intake manifold equivalent to or exceeding the engine displacement such that the intake charge does not enter the crankcase, and contaminants in the crankcase do not reach the combustion chamber, along with an optional trap to assist in the separation of crankcase gas from intake charge; or any combination of the above embodiments. These and other advantages of the present disclosure will become apparent to those of ordinary skill in the art after having read the following detailed description of the preferred embodiments, which are also illustrated in the various drawing figures.

BRIEF DESCRIPTION OF THE DRAWINGS

The drawings included herewith are incorporated in and form a part of this specification. The drawings illustrate one embodiment of the present disclosure and, together with the description, serve to explain the principles of the invention. It should be understood that drawings referred to in this description are not drawn to scale unless specifically noted.

FIGS. 6A-6B are cutaway diagrams of an engine using a filter/screen barrier.

FIGS. 7A-7C are cutaway diagrams of an engine using a diaphragm barrier.

FIGS. 7A-7B are cutaway diagram of an engine using a diaphragm barrier.

DETAILED DESCRIPTION OF THE INVENTION

Reference will now be made in detail to the preferred embodiments of the invention. Examples of the preferred embodiment are illustrated in the accompanying drawings. While the invention will be described in conjunction with the preferred embodiments, it is understood that the invention is not limited to these embodiments. Rather, the invention is intended to cover alternatives, modifications and equivalents, which may be included within the spirit and scope of the invention, as defined by the appended claims. Additionally, in the following detailed description of the present disclosure, numerous specific details are set forth in order to provide a thorough understanding of embodiments of the present invention. However, it will be apparent to one of ordinary skill in the art that the present invention may be practiced without these specific details. In other instances, well-known methods, procedures, components, and operations have not been described in detail so as not to unnecessarily obscure aspects of the present invention.

A. Function of Reducing Contaminant from Two-Stroke Engine

Figure 1:
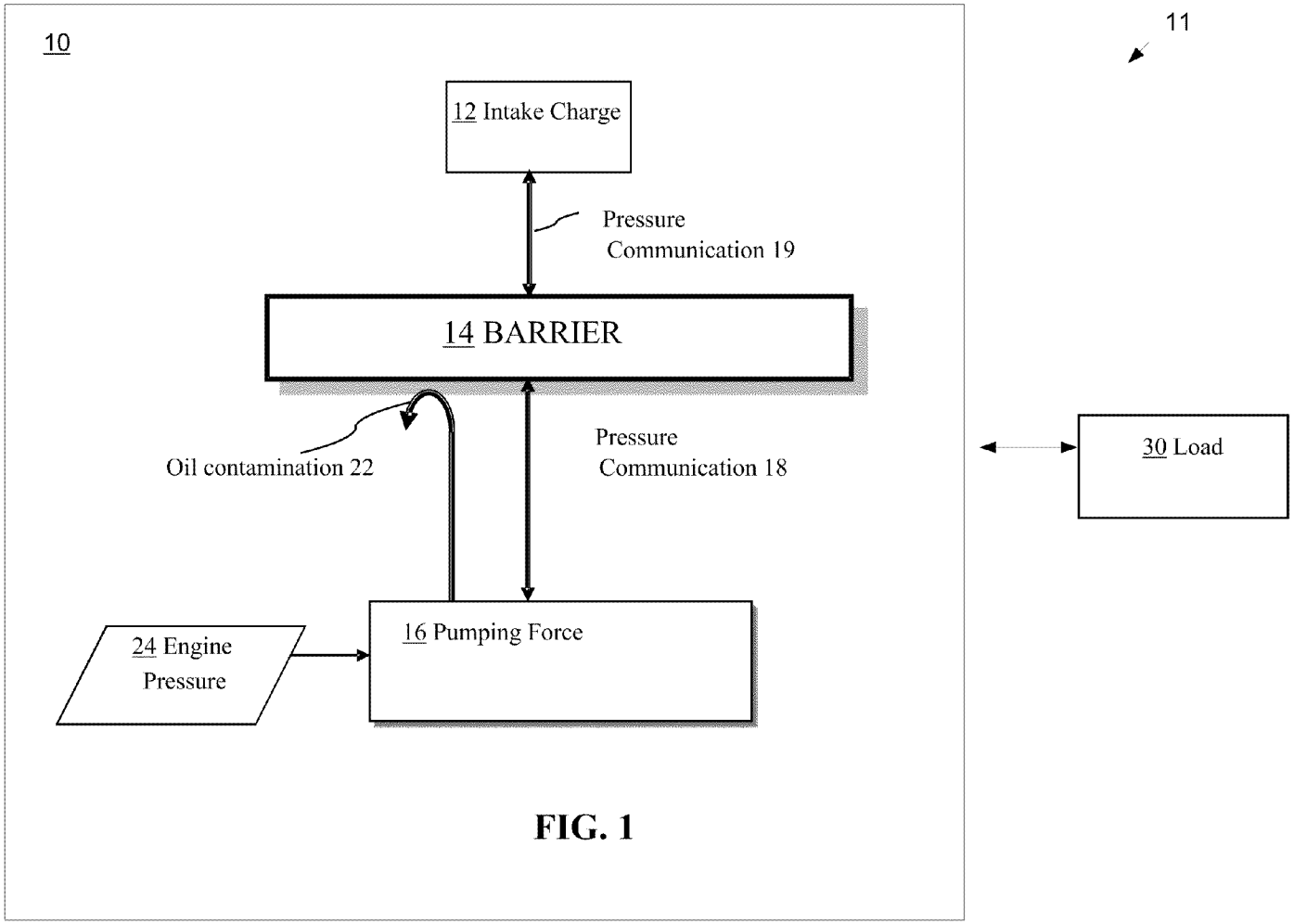
FIG. 1 is a functional block diagram of an engine-powered system having a reduced-contaminant crankcase-pumped engine intake charge.

Referring now to FIG. 1, a functional block diagram of an engine powered system 11 having a reduced-contaminant crankcase-pumped engine intake charge is shown, in accordance with one embodiment of the present disclosure. Functional block diagram provides a functional representation of exemplary apparatus and processes embodiments described hereinafter.

Engine-powered system 11 includes a load function 30 coupled to an engine function 10 which itself includes an intake charge 12 coupled to a pumping force 16 via a barrier 14, e.g., a hinged flapper, a reciprocating piston, etc. Engine pressure input 24, e.g., crankcase pressure, provides the motivating force for pumping intake charge 12 into an engine. Pressure communication 18 occurs between the pumping force 16 and the positive displacement barrier 14, while pressure communication 19 occurs between the positive displacement barrier 14 to the intake charge 12, the positive displacement barrier 14 substantially inhibits, eliminates, or reduces contamination 22 of the intake charge 12 into the engine, e.g., into a combustion chamber. Oil contamination refers to the presence of aerated lubricating oil or oil mist, e.g. from an engine crankcase, and more generally to other contaminants such as blowby contaminants from combustion chamber past engine piston. Oil contamination does not refer to diesel fuel, a fractional distillate of petroleum fuel oil, which could be an intended fuel source for the engine, e.g., a diesel 2-stroke, though it could refer to byproducts of diesel oil combustion that enter the crankcase.

By utilizing the pumping force 16 to provide the pressurizing force in the present embodiment, pressurization of an intake charge 12 for two-stroke operation is obtained. With the utilization of the barrier 14, contamination of the intake charge 12 can be inhibited or essentially eliminated, and thus pollution can be significantly reduced, while the potential power and vehicular applications can be substantially increased. While the present embodiment provides the pumping force 16 via engine pressure 24, such as crankcase pressure, the present disclosure is well suited to using other forces to provide the pressurization of the intake charge, such as exhaust pressure. Load function 30 can be any load bearing device such as an electrical generator, a drivetrain for an automobile, boat, etc.

Figure 2:
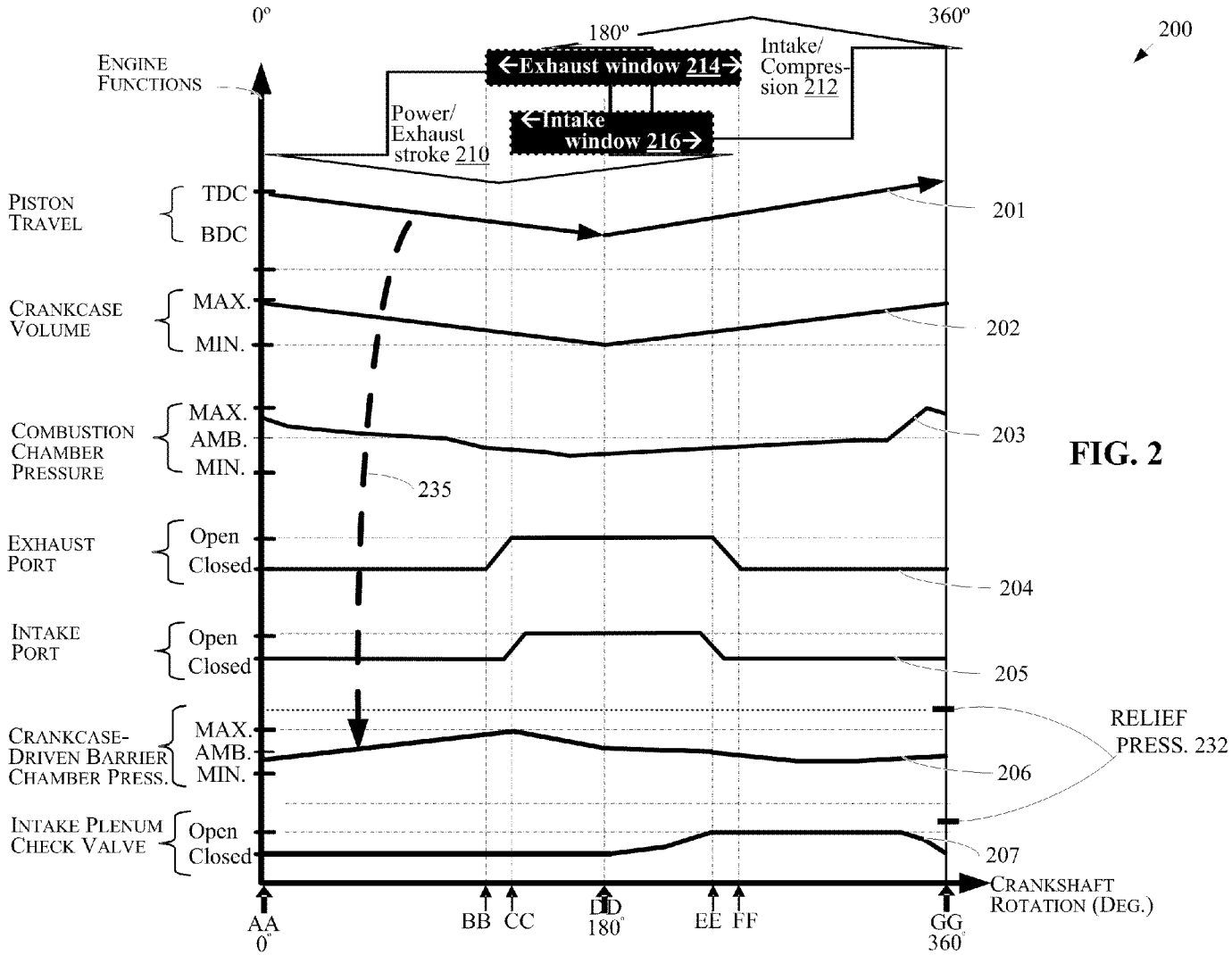
FIG. 2 is a timing diagram of a two-stroke engine with a reduced-contaminant crankcase-pumped engine intake charge.

Referring now to FIG. 2, timing diagram 200 is shown of a two-stroke engine cycle utilizing crankcase pressure to pump an intake charge into a combustion chamber while substantially eliminating contamination of the intake charge, in accordance with one embodiment of the present disclosure. The timing diagram 200 in FIG. 2 illustrates how the functional block diagram 10 in FIG. 1 provides the pressure communication from the pumping force 16 of the engine to the intake charge 12. Timing diagram 200 illustrates multiple engine operations that occur simultaneously, on the vertical axis, as the engine crankshaft rotates, at different angles (from 0° to 360°) as shown on the abscissa.

Piston travel 201 completes one cycle from top dead center (TDC), position AA at approximately 0° rotation, which is the highest point in the cylinder the piston can travel, to bottom dead center (BDC), position DD at about 180° rotation, which is the lowest point in the cylinder the piston can travel, and back up to top dead center, or approximately 360° rotation, at position GG. In the first half of the cycle, e.g., the first 180° of rotation, a power portion of power/exhaust stroke 210 occurs approximately at TDC and continues as the piston is pushed downward. As piston travel 201 moves from TDC toward BDC, it initially exposes, or opens, exhaust port 204 at position BB, thus starting an exhaust portion of power/exhaust stroke 210. Similarly, it secondarily exposes, or opens, intake port 205, at position CC, thus starting an intake portion of intake/compression stroke 212. Intake window 216 and exhaust window 214 represent the total exposure of the intake and exhaust ports, respectively, over the piston travel 201 and crankcase rotation. In the second half of the cycle, piston travel 201 varies from BDC at position DD 180° to TDC at position GG, at 360°, to complete a full cycle. With piston travel 201 at BDC, the exhaust port 204 and the intake port 205 are fully exposed, and thus continue to respectively communicate an intake charge into, and exhaust gases out of, a combustion chamber in a cylinder of the engine. As piston travel 201 moves back from BDC to TDC, intake port 205 becomes closed at position EE while exhaust port 204 becomes closed at position FF thus more fully contributing to a compression portion of intake/compression stroke 212.

As crankcase volume 202 decreases during the down stroke of piston travel 201, during the first 180° of the cycle, crankcase/barrier chamber pressure 206 increases as shown by arrow 235. The force of crankcase/barrier chamber pressure 206 is communicated between the crankcase and the barrier chamber by a barrier that inhibits or eliminates contamination of an intake charge in the barrier chamber.

Intake check valve 207 timing is closed during the engine cycle, except during a substantial portion of intake/compression stroke 212, as shown between crank rotation points FF and GG. At this time, the lower crankcase/barrier chamber pressure 206 is approximately 'minimum', e.g., a low pressure area, or vacuum, that allows a higher pressure force provided by an ambient pressure or by turbocharging or supercharging to move an intake charge into an barrier chamber, or reservoir, of an engine. Correspondingly, crankcase volume 202 reaches a minimum volume as a piston travels down on the power/exhaust stroke 210 to BDC at position DD. Conversely, crankcase volume 202 reaches a maximum volume as a piston travels up on the intake-compression stroke 212 toward TDC at position GG, thereby expanding the crankcase volume and reducing crankcase/barrier chamber pressure 206.

Timing diagram 200 is provided for qualitative and illustrative purposes. Thus, specific angles, overlaps, window sizes and locations, etc. may vary over a wide range of values For example exhaust and intake port relative timing, offsets, window sizing, timing duration, etc. can vary widely depending upon a given engine application. The variation in window sizing, location, and timing can depend on specific designs and applications of a given engine, e.g., torque, max revolutions per minute, horsepower, power bands, etc. for which the present disclosure is well suited.

Figure 3B:
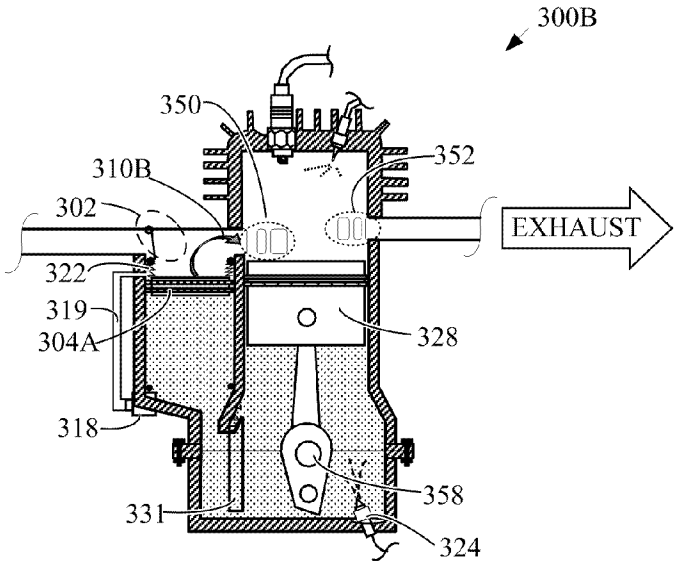
FIGS. 3A-3B are cutaway diagrams of an engine using a piston barrier for a reduced-contaminant crankcase-pumped engine intake charge.

B. Apparatus for Eliminating Oil and Other Contaminants from Two Stroke Intake Charge Referring now to FIGS. 3A and 3B, cutaway diagrams are shown of an engine configuration 300A and 300B, respectively, using a piston type of barrier, or barrier member, to pump an intake charge using crankcase pressure while inhibiting, reducing, or eliminating contamination of the intake charge, in accordance with one embodiment of the present disclosure. An intake charge is an air or air/fuel mixture that is fed into the engine combustion chamber. FIGS. 3A and 3B and subsequent figures may utilize similar illustrative engine construction, components, and operation and similar pumping function, method and apparatus. To the extent that those similarities exist, the descriptions provided herein also apply to those subsequent figures. FIG. 3A shows piston barrier 304 in a low position, having received a fresh intake charge 303. In contrast, FIG. 3B shows piston barrier 304 in a high position, having pumped intake charge 303 into the combustion chamber 329. Thus piston barrier effectively provides pumping action for, and reducing oil contamination of, intake charge 303.

Engine 300A includes crankcase 326 that houses cylinder 327 within which piston 328 reciprocates. In the present figure, piston 328 is shown at top dead center (TDC). An intake manifold 312 is coupled to cylinder 327 to provide an intake charge of either air or an air/fuel mixture into barrier chamber 301, e.g., a barrier chamber housing, via flow path 310A, while exhaust manifold 323 is coupled to the cylinder 327 to provide a route for the exhaust gases to exit the combustion chamber 329. A manifold refers to a chamber having at least one openings through which a fluid, e.g., intake charge or exhaust gas, is distributed or gathered. For a single cylinder engine, a manifold can be a single channel through which fluid can flow, and for a multi-cylinder engine, a manifold can be a collection of channels, or pipes, through which fluid can flow.

If the intake charge provided to combustion chamber 329 via intake manifold 312 and barrier chamber 301 is only air, then an injector 338 located in engine head 340 can provide fuel directly into the combustion chamber 329. However, if the intake charge provided to the combustion chamber 329 is a fuel/air mixture, then injector 338 is not utilized, and an alternative fuel delivery system (not shown) may be used, such as a carburetor, or an upstream injector, such as a throttle-body injector (TBI), central port injection (CPI), etc. that can provide the fuel delivery outside of the combustion chamber 329, e.g., in the intake manifold 312, or barrier chamber 301.

The intake manifold 312 and the exhaust manifold 323 are respectively coupled to intake ports 350 and exhaust ports 352 in cylinder 327. Cutaway FIG. 3B illustrates a fraction of the intake ports 350 and exhaust ports 352 in engine 300B with their respective circumferential clocking and their height location in cylinder 327. However, present disclosure can have a wide range of quantities and a wide range of angular positions around for intake ports 350 and exhaust ports 352, depending on the desired performance from engine 300B. The present invention is well-suited to any type of ports or valving to communicate intake charge into the combustion chamber A barrier chamber 301 is coupled to intake manifold 312 to store an intake charge and to pump it into combustion chamber 329. Barrier chamber 301 can be housed in crankcase housing 326, intake manifold 301, a separate structure, or a combination thereof. A check valve 302, located upstream of the intake barrier chamber 301 allows the intake charge to be pushed by higher pressure ambient environment, e.g., drawn or pulled, into barrier chamber 301 as shown by precharge path 310A. In particular, as piston 328 approaches TDC to increase the volume 202 of air in the crankcase, and lower crankcase pressure 206 to a 'minimum' level as shown in FIG. 2, check valve 302 opens and intake charge to be pushed into barrier chamber 301 via path 310A. Check valve 302 can be any type of valve, e.g., reed, flapper, poppet, flap, butterfly, etc. that allows intake charge to flow only in one direction.

Barrier 304A is a piston, in the present embodiment, having one or more optional piston rings to provide pressurizing capability and to provide a seal that inhibits contamination between intake charge 303 and crankcase contaminants 306, such as blowby and engine lubricating oil mist, thereby inhibiting the latter from entering with the intake charge into combustion chamber 329. Barrier 304A has a diameter to length ratio that prevents cocking and binding within barrier chamber 301. In order to reduce mass and provide a very light weight barrier that is responsive to pressure, one embodiment of barrier 304A can be made of a lightweight material of sufficient strength and rigidity such as silica-ceramic tile material, e.g., similar to that used on the United States space shuttle, or such as an aerogel within a rigid and thin ceramic fiber or metal skin. One or more springs 322 of any design, such as a coil spring, which can assist with the return of the barrier 304A to its lower position, for drawing in the intake charge, may be used. Alternatively, the piston may be allowed to float freely within barrier chamber 301. Stops 330 provide a limitation on the movement of barrier 304A at the bottom of its travel while one or more springs 322, or another stop (not shown), may be used to limit barrier 304A at the top of its travel. If exhaust pressure is the force used to pump the intake charge into the cylinder, then a counter force, such as a spring, an elastic nature of the barrier material, a counter-cycle pressure, air spring, or combination of the above may be used to return the barrier to its original position, and thereby draw in an intake charge into barrier chamber 301 before the next cycle.

Barrier 304A communicates the pressure that is developed in the crankcase 326 to the intake charge in barrier chamber 301. Thus, only a slight pressure differential exists across barrier 304A due primarily to the travel of the piston communicating the pressure to the opposite side. Consequently, barrier 304A does not require an overly structurally rigid. For example, an oil and/or pressure ring in barrier 304A is not required in one embodiment that simply has a sufficiently narrow gap, between barrier 304A or 304B and the walls of crankcase 326 that house it, to effectively communicate pressure from crankcase 326 to barrier chamber 301. Lubrication is provided to the moving parts, such as piston 328 and crankshaft 358, via an engine oil atomizer 324 housed in the crankcase 326 that produces a misted oil/air portion of crankcase contaminants 306 is shown as a gray area in the crankcase. Alternative methods of lubrication, such as splash lubrication, wet and dry sumps, etc., may be utilized with the present disclosure. In one embodiment, oil with a high mass, or density, may be utilized for a splash lubrication to help reduce vaporization of oil in the crankcase, and thereby reduce the possibility it will escape past seals of the barrier 304A and into the combustion chamber 329. A spark plug 337 in the engine head 340 is also illustrated for the embodiment that utilizes a gasoline type fuel. For a diesel, biodiesel, etc. applications, a glow plug for cold starts may be utilized in lieu of a spark plug. The present embodiment is suitable to all types of fuel such as biodiesel, diesel, ethanol gasoline, hydrogen, methane, propane, or any other combustible material.

Referring in particular to FIG. 3B, engine 300B is shown during an exhaust portion of the two-stroke cycle, in accordance with one embodiment of the present disclosure. When piston 328 is at bottom dead center (BDC), then the volume of the crankcase 326 is minimized. In the engine embodiment with multiple cylinders (not shown), each cylinder can be pressure isolated from the balance of the cylinders, e.g., via a separator wall, thus allowing each cylinder to capture the crankcase pumping mechanism described herein. Thus, the crankcase pressure increases to a maximum level, as shown by crankcase driven intake barrier chamber pressure 206 in FIG. 2. The higher crankcase pressure drives barrier 304A upwards, closing the check valve 302, and pumping the intake charge into the cylinder, as shown by intake charge path 310B. Barrier 304A continues its stroke until it reaches a stop, or until spring 322 is sufficiently compressed or until a pressure in the barrier chamber 301 is equal to or greater than the pressure in the crankcase 326. If barrier 304A reaches its stop prior to the piston 328 reaching BDC, then either the blowby pressure relief valve 318 may discharge the excessive pressure, or the pressure may be allowed to build up in the crankcase 326, thereby acting as an air spring to drive the piston 328 back up in the cylinder 327. Separator wall 332 extends down in the present embodiment to help reduce the chance that oil particulates will be driven against the bottom side of barrier 304A. Alternatively, having a circuitous pattern for separator wall 332, e.g., a labyrinth, will allow air to travel thereto while inhibiting oil particles because of their momentum and weight. An oil gutter 331 is disposed at the bottom of separator wall 332 to prevent oil from dripping over an inlet to the barrier chamber 301 and being swept up by gasses moving into barrier chamber 301.

Check valve 302 can be any kind of valve, such as a reed valve, poppet valve, etc., that allows air to flow one way from intake 312 into barrier chamber 301, but not from barrier chamber 301 to intake 312. Check valve 302 closes approximately when the pressure inside the barrier chamber is greater than the pressure in the intake 312. In contrast, blowby pressure relief valve 318 is located in crankcase 326 in the present embodiment, as an option for relieving any excessive pressure in the crankcase 326, e.g., caused by 'blow by' gases past piston 328 and into crankcase 326. While blowby pressure relief valve 318 is especially useful for solid medium barriers, e.g., bellows, flapper, piston, bladder type barriers, it is not necessary for non solid medium barriers, e.g., gaseous or filter barriers. Blowby pressure relief valve 318 is any type of valve or backpressure device, such as a spring loaded poppet valve, with an air filter for reducing oil contamination, etc., that can communicate excessive pressure from crankcase 326 to the inlet to the engine intake ports 350, e.g., via tube 319.

As shown in FIGS. 3A-3B and subsequent figures, one of the benefits of separating crankcase contaminants 306 from the intake charge 303 is that the lubricating oil portion of crankcase contaminants 306 is not thinned from any fuel, e.g., gas, in the intake charge 303, and thus will not diminish its lubricating ability. While the present embodiments illustrate an air cooled engine, with cooling fins, the present invention is well-suited to water cooling.

Figure 3D:
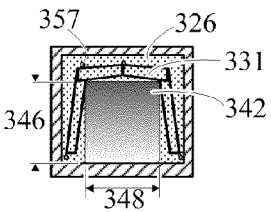
FIG. 3D is a side-section view of the engine crankcase port leading to the barrier chamber.
Figure 3A:
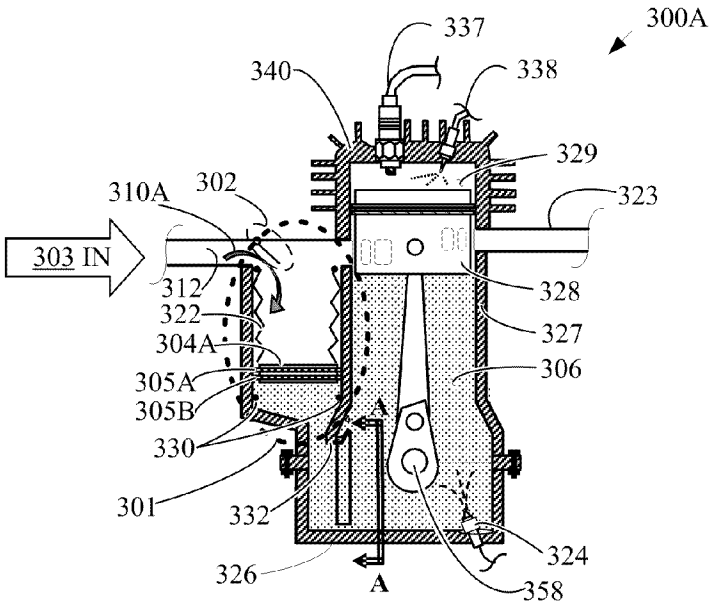
Figure 3C:
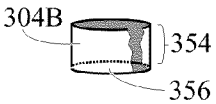
FIG. 3C is an alternative piston barrier.

Referring now to FIG. 3C, an alternative piston barrier is shown, in accordance with one embodiment of the present invention. Alternative piston barrier 304B is a lightweight thin-walled piston that is hollow, e.g., similar to an aluminum can cut parallel to the end of the can with a portion of the body included, thereby providing long sidewall skirts 354 and a head 356, with an appearance similar to an engine piston. Head 356 can be any shape for providing a surface to capture the pressure and for providing rigidity and strength, e.g., any combination of flat, convex, concave, etc. shapes. Alternative piston barrier 304B can utilize: piston rings, not shown, to provide sealing against cylinder walls of barrier chamber; or a ringless design, as shown, that relies on either a close fit between the alternative piston barrier 304B and the cylinder walls, or relies on the expansion of the piston skirt 354 against the cylinder walls, e.g., barrier chamber 301, to provide sealing. In another embodiment, the thin-walled alternative piston barrier 304B may be right side up or inverted, as shown, with a cutaway view of the cross-section of the thin-walled piston skirt 354. With the long side wall skirts 354 the thin-walled piston 304B is much less likely to bind in barrier chamber 301. Location of stops 330 would be adjusted to accommodate a specific length of piston skirt 354.

Referring now to FIG. 3D, a side-section view of the engine crankcase port 342 leading to the barrier chamber 301, in accordance with one embodiment of the present invention. In particular, crankcase port 342 has a height 346 and a width 348 sufficient to communicate pressure from crankcase 327 to barrier chamber 301. Crankcase port 342 is preferably placed in a location of minimal oil slinging and misting inside crankcase 326 to help prevent oil contamination of intake charge 303. Oil gutter 331 is shown in greater detail, to reduce or prevent oil dripping 357 along side of crankcase wall 326 from getting into gases swept into barrier chamber 301 of FIG. 3A via port 342. In another embodiment, oil gutter 331 has an open top portion along top of engine crankcase port 342 to accept oil drippings 357, but is a closed tube along sides of engine crankcase port 342 to drain oil back to the bottom of crankcase 326.

Figure 4B:
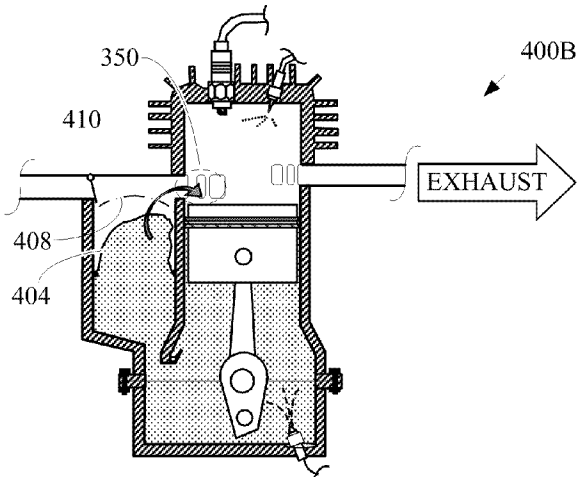
FIGS. 4A-4B are cutaway diagrams of an engine using a bladder barrier.
Figure 4A:
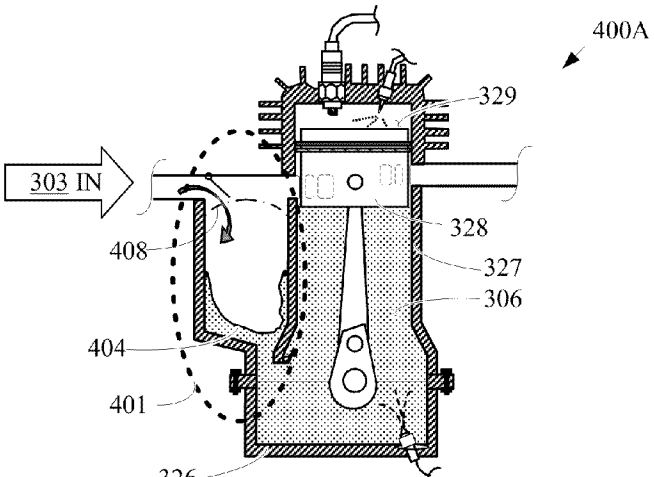

Referring now to FIGS. 4A and 4B, cutaway diagrams are shown of engine configuration 400A and 400B, respectively, using a bladder type of barrier 404 to pump a reduced-contaminant crankcase-pumped engine intake charge 303 into combustion chamber 329, in accordance with one embodiment of the present disclosure. The pumping action generated from engine piston 328 is essentially the same as described in FIGS. 3A and 3B except that bladder barrier 404, in lieu of piston barrier 304A, performs the function of pumping intake charge 303 into combustion chamber 329. FIG. 4A shows bladder barrier 404 in a collapsed position, having received a fresh intake charge 303. In contrast, FIG. 4B shows bladder barrier 404 in the extended position, having pumped intake charge 303 into the combustion chamber 329. Thus bladder barrier 404 effectively provides pumping action for, and reducing oil contamination of, intake charge 303.

Bladder type barrier 404 is any material, or combination of materials, that provide a flexible, heat-resistant, hermetically-sealed, chemical-resistant, and fatigue-resistant barrier. In this configuration, bladder type barrier 404 has an advantage over piston barrier 304A because it has extremely low mass, does not need a spring force to return it to its original position, doesn't bind, and it provides a flexible and flowing barrier that can adapt to many applications. For example, one embodiment of bladder type barrier 404 is a neoprene-impregnated fabric, while another embodiment is a flexible plastic barrier without fabric. Many other types of materials and designs may be used for the present disclosure. For example, in another embodiment, bladder 404 is not hermetically sealed, but is a membrane that is air but not oil permeable.

A blowby pressure relief valve similar to 318 in FIG. 3B may vent excessive pressure from the crankcase 326 that might otherwise deform or rupture bladder 404. Another embodiment that prevents damage to the bladder 404 from blow-by pressure is to utilize a retainer 408 at the top of travel of bladder 404 that will retain the bladder 404 in the barrier chamber 401, and thus reduce the possibility of bursting bladder 404. Retainer 408 can be a plate with holes or perforations, a screen with a wide variety of pitches and gauges to effectuate efficient air flow and bladder retention. The plate would support the bladder 404 upon contact by transferring the load generated from the pressure in crankcase 326 to the retainer 408, and thus preserve the integrity of the bladder 404. The holes or perforations in retainer 408 would allow the low-restriction passage of intake charge 303 into combustion chamber 329. A retainer can be utilized at the bottom of travel of bladder 404, but is not required because the potential pressure differential is much lower. In one embodiment, bladder 404 can be an easily removable cartridge housing to facilitate preventative maintenance or repair of a degraded or damaged bladder 404. Finally, bladder 404 is well-suited to having a wide variety of shapes, designs, orientation, construction and materials to enable its function.

Figure 4C:
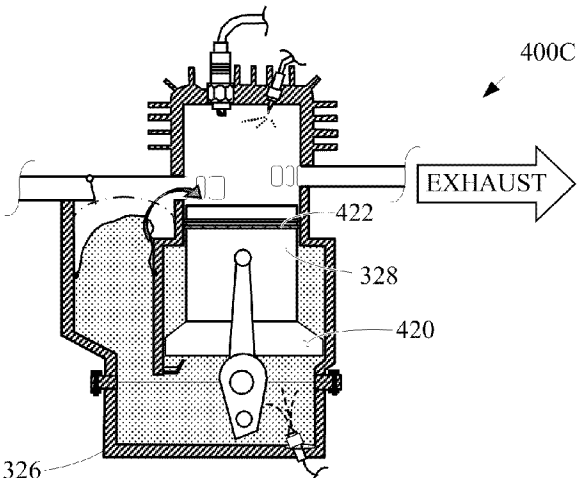
FIG. 4C is a cutaway diagram of an engine using a stepped piston skirt for generating increased crankcase pressure.

Referring now to FIG. 4C, a cutaway diagram of an engine 400C with a stepped piston design for generating increased crankcase pressure is shown, in accordance with one embodiment of the present disclosure. Use of a barrier chamber in the present embodiment may increase the overall volume available to pump an intake charge because of the combined volume of the crankcase and the barrier chamber. This may consequently reduce the compression ratio of the crankcase gases and/or the intake charge. If the compression ratio for the intake charge is insufficient, then a stepped piston design may compensate by increasing the pumping action of the piston and thereby generating a sufficient compression ratio or pumping action for the intake charge. The stepped piston design, having a skirt diameter larger than the head diameter of the piston, can be used with any barrier embodiment.

Additional pumping action and/or increased pressure in the crankcase that may act to supercharge the intake charge is realized by a stepped skirt 420 portion of piston 328 which effectively increases the diameter of a lower portion of the piston compared to the head, or top, of the piston, which thereby increases the pressure in crankcase 326. To accommodate larger diameter stepped skirt 420, crankcase 326 is enlarged in at least the portion of travel of stepped skirt 420. Pressure buildup between skirt 420 and piston rings 422 can be accommodated by a relief valve, by porting between the stepped skirt 420 and crankcase 326, or by a sufficient clearance between stepped skirt 420 and crankcase 326 to allow nominal air passage, without significantly hampering crankcase pressure for pumping intake charge. Alternatively, engine 400C has sufficient clearance between crankcase 326 and stepped piston skirt 420 when piston 328 is at top dead center to provide a volume for any trapped gasses therein, and thereby avoid over pressurization.

Figure 5B:
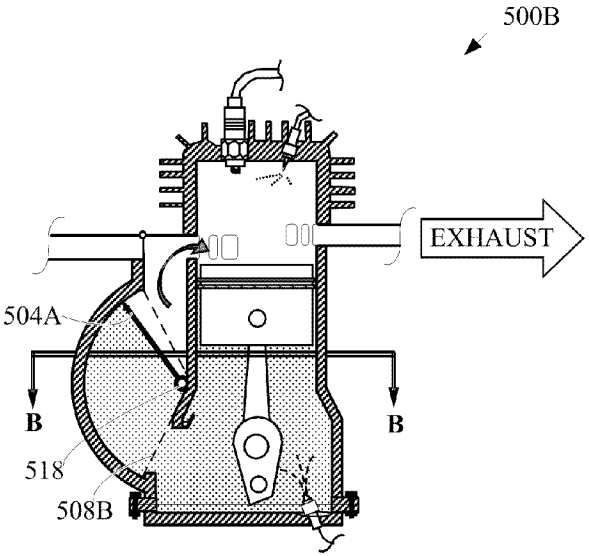
FIGS. 5A-5D are cutaway diagrams of an engine using a hinged flapper barrier.
Figure 5D:
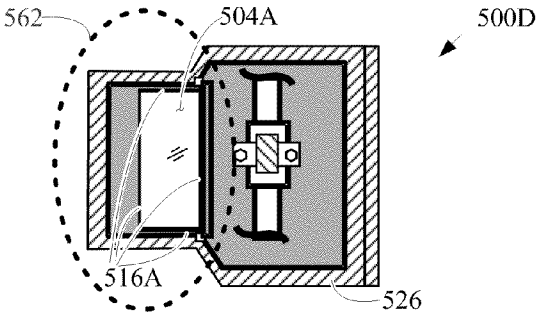
Figure 5A:
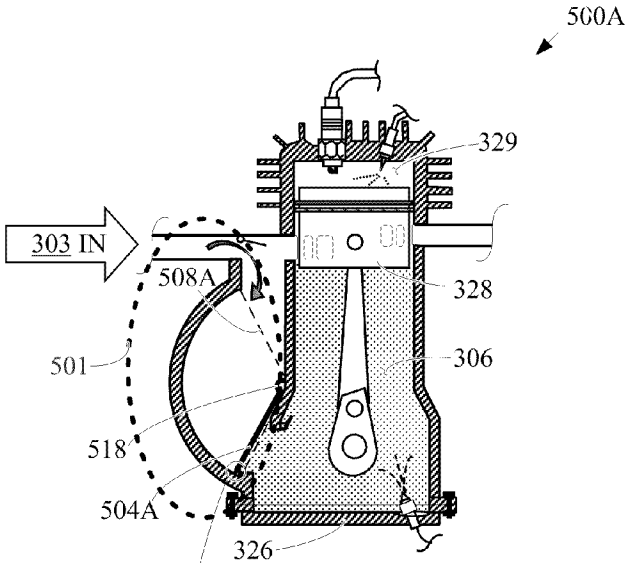

Referring now to FIGS. 5A and 5B, cutaway diagrams are shown of engine configuration 500A and 500B, respectively, using a hinged flapper type of barrier 504A to pump an intake charge using crankcase pressure while reducing contamination of the intake charge, in accordance with one embodiment of the present disclosure. The pumping action generated from flapper barrier 504A is essentially the same as described in FIGS. 3A and 3B except that flapper barrier 504A, in lieu of piston barrier 304A, performs the function of pumping intake charge 303 into combustion chamber 329.

FIG. 5A shows flapper barrier 504 in a collapsed position, having received a fresh intake charge 303. In contrast, FIG. 5B shows flapper barrier 504 in the extended position, having pumped intake charge 303 into the combustion chamber 329. Thus flapper barrier 504 effectively provides pumping action for, and reducing oil contamination of, intake charge 303 by using a reciprocating rotational, or circumferential, motion between the extended position and the collapsed position. Similar to retainer 408 of FIG. 4A, retainers 508A and 508B in the present figure perform the same function of limiting barrier travel. Retainers 508A and 508B are located in barrier chamber 501 at the top and/or bottom, respectively, of the travel of hinged flapper barrier 504. Thus hinged flapper 504 effectively provides pumping action for the intake charge 303 while reducing oil contamination of intake charge 303 to be burned in the cylinder.

Figure 5C:
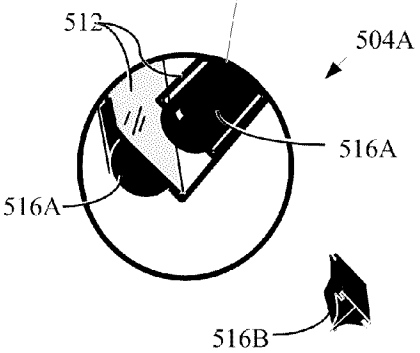

Flapper 504 swings about hinge 518 positioned in barrier chamber 501 with a sufficiently tight clearance to prevent excessive leakage in one embodiment. Alternatively flapper barrier 504A has seals on the moving edges, such as hemicylindrical seals 516A, wiper seals 516B, or other similar seals, as shown in FIG. 5C isometric view of a corner of flapper barrier 504A to provide effective pumping of the intake charge 303, and reduction of crankcase contaminants 306. Seals can be provided as a non-continuous material on each of the sides of the flapper or as a continuous material around the moving areas of the flapper 504, or around the entire circumference of the flapper 504, with varying levels of sealing efficiency and friction losses. Flapper 504 has bent side walls 512 to provide additional rigidity with minimal additional mass, thereby improving the responsiveness and efficiency of the pumping action of hinged flapper 504. Hinge 518 can use moving components, such as a pivot, butt, continuous hinge, live hinge, or the like, that are lubricated by presence of lubricating oil in crankcase 326. Hinge 518 has a single pivot point or axis such that the flapper 504 rotates in a circumferential motion, providing a high volumetric change for a small angular rotation of the joint at the hinge. Alternatively, hinge 518 can use non-sliding but flexible material such as a fabric hinge, with preformed creases or bellows to provide flexibility and fatigue resistance. Flapper 504 is shown as a flat member, but can have contours and other shapes incorporated therein to provide improved flow characteristics, e.g., via a convex or concave shape. By utilizing a hinge and seal configuration, optimally with lubrication, the present embodiment avoids material fatigue issues associated with a clamped bladder or diaphragm embodiment.

Referring now to FIG. 5D a cross-section view B-B 500D of the hinged flapper barrier 504A is shown, in accordance with one embodiment of the present disclosure. Flapper 504A has seals 516A contacting walls of barrier chamber 501 to provide effective pumping of intake charge, e.g., prevent leakage around contact areas between flapper barrier 504A and walls of barrier chamber 501, and thus provide efficient pumping action. The displacement of the barrier chamber 501 is approximately equivalent to the displacement of the engine.

Referring now to FIGS. 6A and 6B, cutaway diagrams are shown of engine configuration 600A and 600B, respectively, using a filter/screen barrier 604 to pump an intake charge 303 using crankcase pressure while reducing contamination of the intake charge 303, in accordance with one embodiment of the present disclosure. The pumping action generated from the engine piston 328 is essentially the same as described in FIGS. 3A and 3B except in the present figure filter/screen barrier 604 is a stationary device and thus avoids maintenance issues associated with moving barriers. FIG. 6A shows filter/screen barrier 604 having filtered a fresh intake charge 303. In contrast, FIG. 6B shows filter/screen barrier 604 having filtered intake charge 303 that is fed the combustion chamber 329 via the crankcase pumping action. Thus filter/screen barrier 604 effectively allows pumping action and reduces oil contamination of intake charge 303.

Filter/screen 604 in FIGS. 6A and 6B may be any filter or screen material, or combinations thereof, with appropriate porosity, oil filtering, and pressure drop characteristics for a given engine application, e.g., engine rpm, horsepower requirement, etc. For example, as porosity size and micron rating of a filter decreases the pressure drop increases and the pumping efficiency decreases. Consequently, a tradeoff arises for oil-filtering performance versus pressure drop and maximum engine ratings. Thus a large surface area of filter helps reduce pressure drop and air velocity while allowing sufficient oil removal from the intake charge and placing the filter barrier higher also assists in reducing the amount of oil that reaches the filter. To effectuate a larger surface area, filter/screen barrier 604 is placed on a steep angle in barrier chamber 601. In another embodiment, filter/screen barrier can use corrugation techniques, known by those skilled in the art, to effectively increase surface area of filter/screen barrier 604 for a given footprint. Filter/screen barrier 604 can be housed in an easily removable cartridge to provide convenient preventative maintenance. Because intake charge 303 flows through filter/screen barrier 604, it will experience a nominal pressure drop which may reduce performance of crankcase pumping action and may require periodic maintenance of filter/screen barrier 604 when pressure drop becomes excessive. Engine 600A utilizes fuel injector 638 or carburetor 618 for providing the fuel supply for the combustion process, thus preventing fuel, such as gasoline, from contacting filter/screen barrier 604 and contaminating lubricating oil in crankcase 326. With this embodiment, a blowby relief valve is not required as the filter/screen barrier 604 accommodates blow by.

Referring now to FIGS. 7A and 7B, cutaway diagrams are shown of engine configuration 700A and 700B, respectively, using a diaphragm type of barrier 704 to pump an intake charge 303 using crankcase pressure while reducing contamination of the intake charge 303, in accordance with one embodiment of the present disclosure. The pumping action generated from the engine piston 328 is essentially the same as described in FIGS. 3A and 3B except in the present figure utilizes diaphragm 704, in lieu of piston 304A, to accommodate the change in crankcase volume and thus to pump intake charge 303 into combustion chamber 329. FIG. 7A shows diaphragm barrier 704 in an inverted position, having received a fresh intake charge 303. In contrast, FIG. 7B shows diaphragm barrier 704 in an extended position, having pumped intake charge 303 into the combustion chamber 329. Thus diaphragm barrier 704 effectively provides pumping action for, and reducing oil contamination of, intake charge 303.

In particular, FIGS. 7A and 7B show diaphragm 704 provides a binary-position interface between barrier chamber 701 and oil-lubricated crankcase 326, with an elastic property that tends to keep it in one position, e.g., extended into the crankcase 326 as shown in FIG. 7A, until a threshold pressure builds up to force it in the other position, e.g., extended into barrier chamber 701 as shown in FIG. 7B. Diaphragm 704 effectively has a memory state as compared to bladder 404 which has none. When diaphragm does change states, it does so with an impulse that can provide a ram effect that drives intake charge 303 into combustion chamber 329 with higher efficiency and lower latency. Similar to retainer 408 of FIG. 4, retainer, or stop, 716 in the present figure performs the same function of limiting barrier travel. Retainer 716 is located in barrier chamber 701 at the expanded position of diaphragm barrier 704 in order to limit travel and prevent diaphragm barrier 704 from sealing against barrier chamber 701 and prematurely blocking intake charge 303 from being delivered into combustion chamber 329.

Diaphragm 704 can be made of any type of material that provides an appropriate flexibility, fatigue resistance, fuel and oil resistance, etc., such as nitrile rubber, flexible cellular polymeric material, other similar materials, or combinations thereof. One embodiment for diaphragm 704 is shown as diaphragm 704A, a partial or full hemisphere, having an optional corrugated type of junction or flange, similar to an audio speaker, near the attachment edge. Diaphragm 704 oscillates from one side of the plane to the other side, as illustrated by the arrows, and as shown in positions of diaphragm 704 in FIGS. 7A and 7B.

Figure 8B:
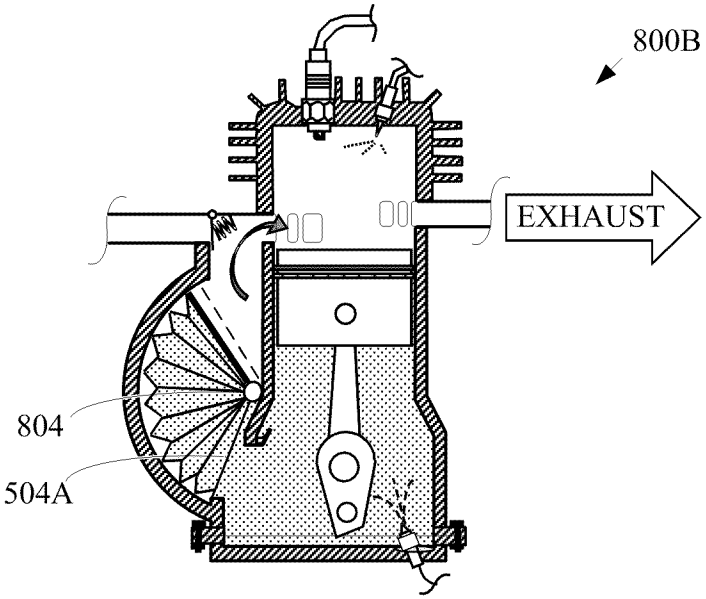
FIGS. 8A-8B are cutaway diagrams of an engine using a bellows barrier.
Figure 8A:
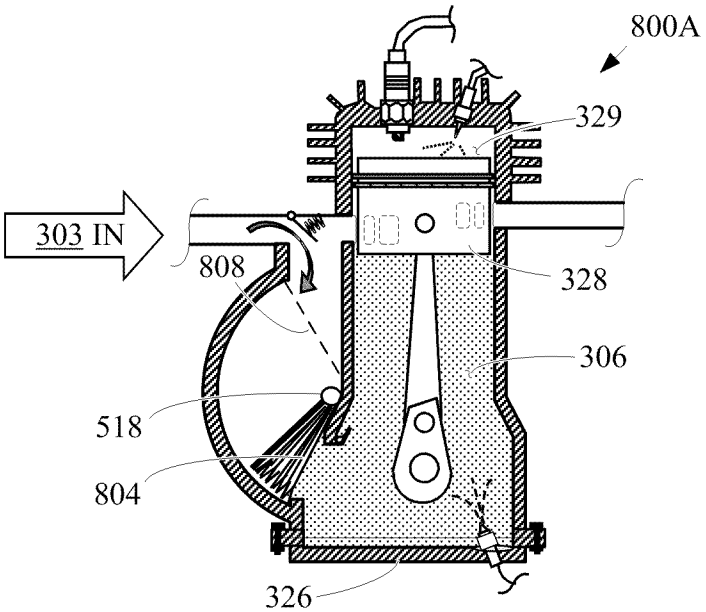

Referring now to FIGS. 8A and 8B, cutaway diagrams are shown of engine configuration 800A and 800B, respectively, using a bellows type of barrier 804 to pump an intake charge 303 using crankcase pressure while reducing contamination of intake charge 303, in accordance with one embodiment of the present disclosure. The pumping action generated from engine piston 328 is essentially the same as described in FIGS. 3A and 3B except that bellows barrier 804, in lieu of piston barrier 304A, accommodates the change in crankcase volume and thus pumps intake charge 303 into combustion chamber 329. The action of the bellows is similar to the reciprocating circumferential, or rotational, motion of flapper barrier 504 described in FIGS. 5A-5D, except that seals are not required with the bellows type of barrier 804. FIG. 8A shows bellows barrier 804 in a collapsed position, having received a fresh intake charge 303. In contrast, FIG. 8B shows bellows 804 in the expanded position, having pumped intake charge 303 into the combustion chamber 329. Thus bellows barrier 804 effectively provides pumping action for, and reducing oil contamination of, intake charge 303.

Bellows 804 may be made of similar construction, material, and installation as bladder 404 of FIG. 4, though bellows 804 has preformed pleated folds for predictable compressed and expanded positions. Alternatively, the present disclosure can use an unhinged cylindrical bellows whose expansion and contraction would be similar to that of a piston with any cross-section shape, e.g., round, square, etc. where sides are corrugated bellows for smoother expansion and contraction. Similar to retainer 408 of FIG. 4, retainer 808 in the present figure perform the same function of limiting barrier travel and is located in barrier chamber 801 at the top of the travel of hinged flapper barrier 804.

Figure 9B:
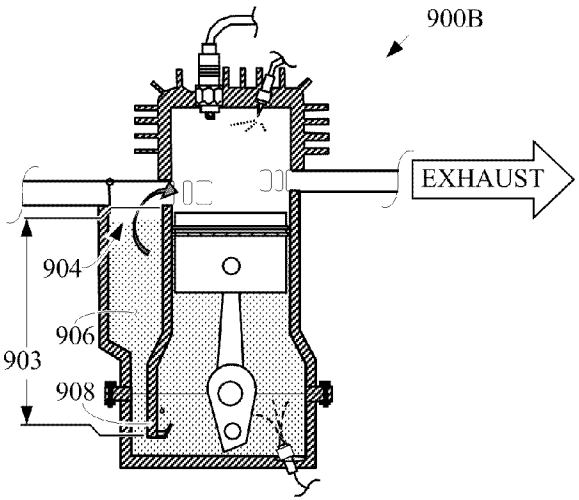
FIGS. 9A-9B are cutaway diagrams of an engine using a gaseous interface barrier.
Figure 9A:
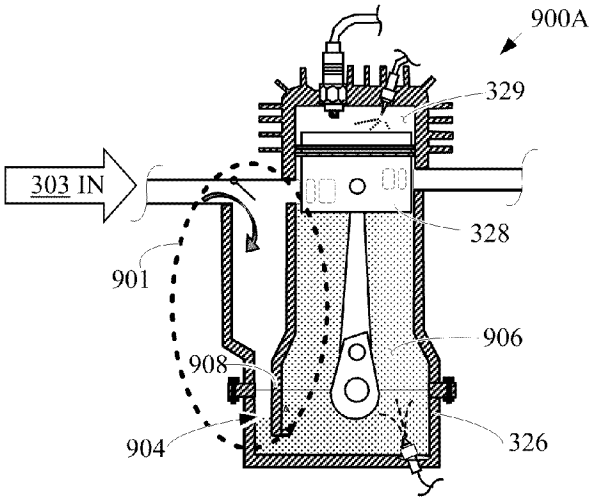

Referring now to FIGS. 9A and 9B, cutaway diagrams are shown of engine configuration 900A and 900B, respectively, using a gaseous interface 904 to pump an intake charge 303 using crankcase pressure while reducing contamination of the intake charge, in accordance with one embodiment of the present disclosure. The pumping action generated from the engine piston 328 is essentially the same as described in FIGS. 3A and 3B except in the present figure the movement of heavier-than-air gas 601, rather than using a physical barrier, e.g., piston 304, to accommodate the change in crankcase volume and thus pumps intake charge 303 into combustion chamber 329. FIG. 9A shows gaseous interface barrier 904 in a low position, having received a fresh intake charge 303. In contrast, FIG. 9B shows gaseous interface barrier 904 in the expanded position, having pumped intake charge 303 into the combustion chamber 329. Thus gaseous interface barrier 904 effectively enables pumping action of intake charge 303 while reducing oil contamination of intake charge 303 by segregating intake charge from crankcase gas due to differences in specific gravity.

A hermetically sealed crankcase 326 will improve retention of the heavier-than-air gas 906. If contamination affects the crankcase gas integrity, e.g., by reducing its density or depleting it, then a recharge of the heavier-than-air gas 906 may be provided. Different embodiments may provide a recharge either manually or automatically, from a local or remote reserve, based on manual or automatic gas sensor evaluation of the crankcase gas composition. Additionally, a barrier wall, or baffle, 908 extends down, with a height 903, to provide a barrier chamber 901 within which intake charge 303 can reside without mixing with crankcase contaminants 906.

In order to prevent contamination of the intake charge with the heavier-than-air gas 906 in the crankcase 326, heavier-than-air crankcase gas 906 and intake charge 303 should be immiscible, e.g., they should not be soluble into each other. Noble, or inert, gases rarely react with other elements. Reasonably heavy noble gases for the present embodiment include Argon, Krypton, and Xenon. In additional to noble gases, other compounds such as sulfur hexafluoride, which is five times heavier than air, are candidates for the heavier-than-air medium 906 in crankcase 326.

TABLE 1.1

Specific Gravity of Select Gases

| Substance | Molecular Weight (g/mol) | Specific Gravity (Air = 1) | Density ($kg/m^3$ = g/l @ 1 bar) |
|---|---|---|---|
| Helium (He) | 4.003 | 0.14 | 0.179 |
| Neon (Ne) | 20.180 | 0.70 | 0.900 |
| AIR | — | 1.00 | 1.292 |
| Argon (Ar) | 39.948 | 1.38 | 1.784 |
| Krypton (Kr) | 83.798 | 2.90 | 3.749 |
| Xenon (Xe) | 131.293 | 4.56 | 5.894 |
| sulfur hexafluoride (SF6) | 146.060 | 4.70 | 6.164 |

Figure 10B:
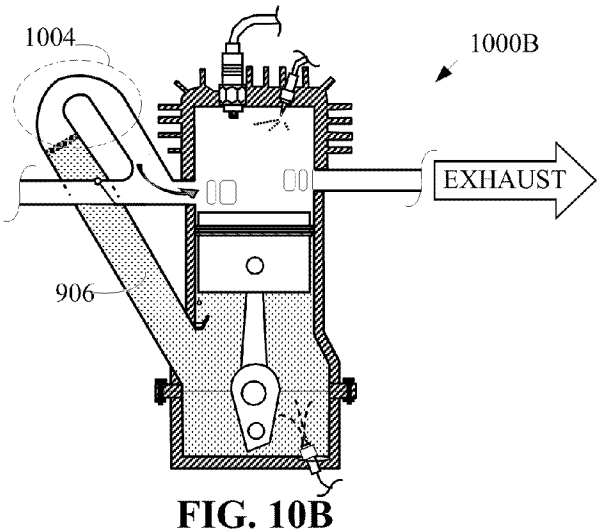
FIGS. 10A-10B are cutaway diagrams of an engine using a fluid trap barrier.
Figure 10A:
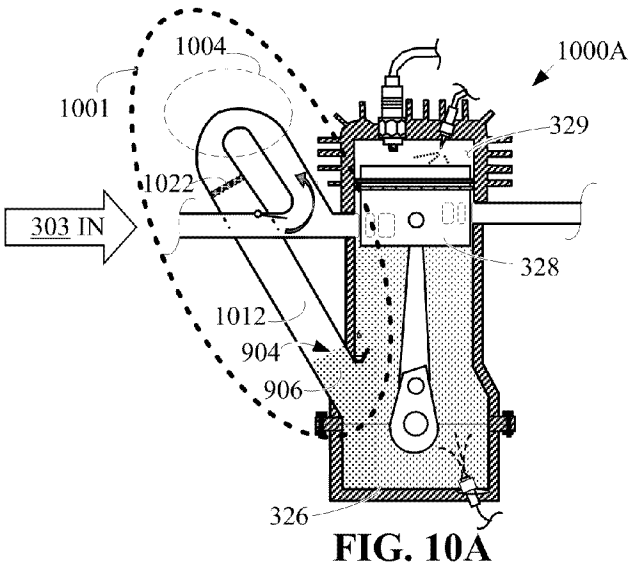

Referring now to FIGS. 10A and 10B, cutaway diagrams are shown of engine configuration 1000A and 1000B, respectively, using a fluid trap 1004 to reduce contamination of the intake charge 303 and using crankcase pressure to pump intake charge 303, in accordance with one embodiment of the present disclosure. The pumping action generated from the engine piston 328 is essentially the same as described in FIGS. 3A and 3B except in the present figure utilizes a manifold 1012 and fluid trap 1004 in barrier chamber 1001, rather than a solid barrier such as piston 304, to accommodate the change in crankcase volume. FIG. 10A shows gaseous interface 904 in a low position, having received a fresh intake charge 303. In contrast, FIG. 10B shows gaseous interface barrier 904 in the expanded position by trap 1004, having pumped intake charge 303 into the combustion chamber 329. Thus fluid trap 1004, effectively provide pumping action for, and reducing oil contamination of, intake charge 303.

FIG. 10A accomplishes the separation of oil contaminant from the intake charge because it does not travel past trap A 1020. Filter 1022 removes any aberrant oil particulate. Sizing and width of intake manifold 1012 should be sufficient to maintain the previously mentioned ranges of gas locations before trap, by sizing the diameter and/or the width of the manifold. To aid fluid trap 1004 in reducing contamination of intake charge, one embodiment combines fluid trap 1004 with optional heavier-than-air gas 601 and gaseous interface 904, as described for FIGS. 9A-9B.

Certain embodiments utilize no moving parts for the pumping action, e.g., FIGS. 6A, 6B, 9A, 9B, 10A and 10B, and thus provide effective pumping of intake charge without the mechanical wear, failure issues, and mechanical losses associated with friction and wear of moving parts. The other moving parts in the larger system include the check valve associated with the directional control of intake charge into the barrier chamber, and the engine piston and optional valvetrain.

C. Process of Eliminating Contamination of Intake Charge

Figure 11:
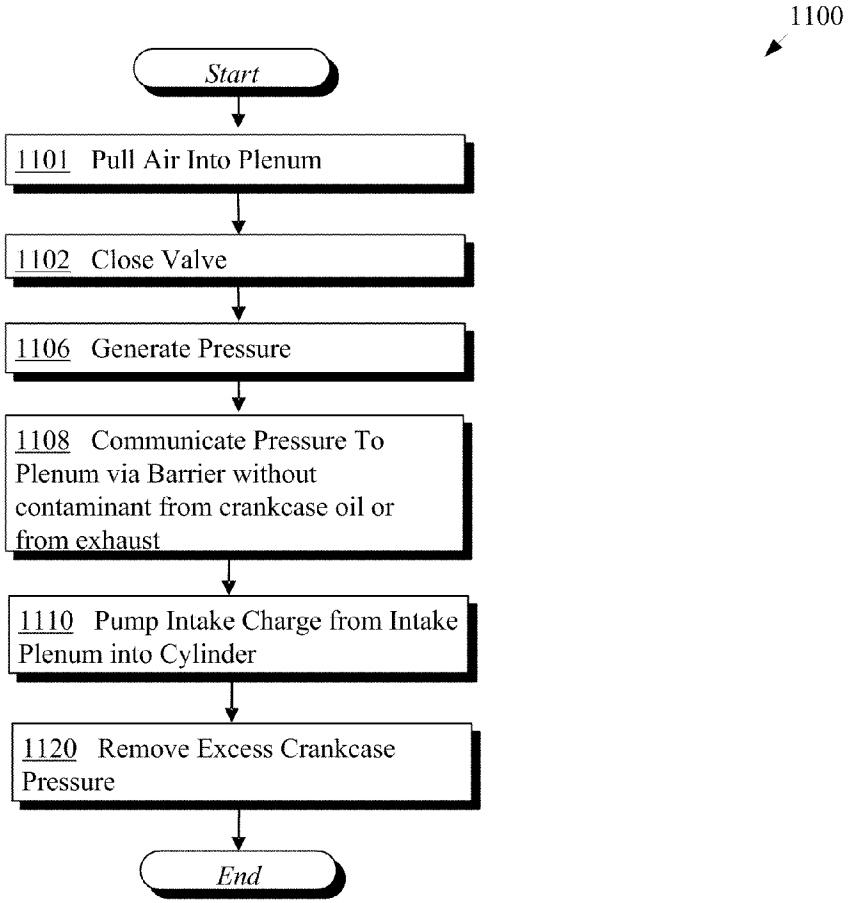
FIG. 11 is a flowchart of a process to pump an intake charge using engine pressure while reducing contamination of the intake charge.

Referring now to FIG. 11, a flowchart 1100 of a process to pump an intake charge using engine pressure while reducing contamination of the intake charge is shown in accordance with one embodiment of the present disclosure.

First step 1100 pulls air into a barrier chamber. In order to utilize a pumping action for feeding an intake charge to the combustion chamber, using a reciprocating pumping action, a barrier chamber is implemented to store the intake charge between a precharge step of pulling in the intake charge, and an intake charge step, of pumping the intake charge into the cylinder. The barrier chamber can have a wide range of sizes, shapes, and configurations, as shown in previous exemplary figures.

Step 1102 closes a valve to seal off the barrier chamber. In order to change direction from a precharge to an intake charge path, a check valve is utilized to allow flow only in one direction. Thus, for example, check valve 302 in FIG. 3A allows the flow of an intake charge in one direction for precharge path into barrier chamber, but not in the opposite direction for intake charge path into cylinder. After TDC the engine piston motion reverses from pulling in the intake charge to starting the push it out, thus closing the intake check valve which allows the intake charge to be pressurized awaiting the opening of the intake ports to the combustion chamber. Intake port 350 acts as a natural check valve, in that when piston 328 is near TDC, it closes off intake port 336, and when piston 328 is near BDC, it opens intake port 350. An additional ring near the bottom of the piston skirt would provide additional sealing on the ports. In some embodiments, more than one check valve is utilized to more precisely control the flow of the intake charge, e.g., as shown in FIG. 6B. Check valve is represented as either a functional check valve symbol or a physical check valve.

Step 1106 generates pressure that is intrinsically present in the engine, e.g., crankcase pressure. Thus, rather than trying to mitigate this source of work, it is utilized to help pump the intake charge into the engine, to improve intake flow and overall engine efficiency. While crankcase pressure is utilized in the present disclosure, the present invention is well-suited to a wide variety of alternative work sources, such as a mechanically driven pump, e.g., from a crankshaft or a camshaft, or from exhaust pressure. If crankcase volume is minimized, then the response of the system will improve because less compressible gas will increase the pressure and velocity of the pumping action.

Step 1108 communicates pressure to barrier chamber via barrier without crankcase oil contamination. The barrier can be a physical barrier such as a piston, diaphragm, flapper, bellows, etc., or it can be a functional barrier, such as a heavier-than-air interface with the intake charge. The design of the barrier chamber will accommodate the engine displacement for all the different configurations above, e.g., the flapper, the piston, the diaphragm, etc. Note that combinations of the aforementioned solutions may be crafted to provide even better engine performance than individual embodiments. Thus, for example, a trap configuration of FIG. 9 may be combined with a heavier-than-air gas in the oil-lubricated section of crankcase.

Step 1110 pumps the intake charge from the barrier chamber into the cylinder. As a natural reaction to the change, or increase, in pressure from the crankcase, as communicated to the barrier chamber by the barrier, the intake charge in the barrier chamber becomes pressurized and is forced into the cylinder, as the downward stroke of the piston exposes the intake port. Thus crankcase pressure is communicated pneumatically, e.g., as a pneumatic coupling, to the barrier, and subsequently to the intake charge.

Step 1120 relieves excess pressure that may be caused from blowby of combustion gases that pass by worn or faulty rings on the engine piston. A pressure relief valve can be set to purge this excessive pressure, while still providing an acceptable pressure level for the intake charge in the barrier chamber.

D. Alternative Embodiments/Retrofitting

The present description is applicable to a wide variety of applications and is not limited to any particular type of engine, fuel, lubricant, or scavenging arrangement. Rather, the present description is applicable to a wide variety of engines including piston, rotary, etc. It is also applicable to a wide variety of fuels including gasoline, ethanol, diesel, fuel oil, biofuel, compressed natural gas (CNG), hydrogen, methane, propane, any other combustible fuel, and combinations thereof. And the present description is applicable to a wide variety of scavenging systems including cross-scavenged, loop-scavenged, uniflow-scavenged, etc. Regarding applications, the present disclosure is applicable and adaptable to a wide range of vehicles and other applications, such as automobiles, motorcycles, snowmobiles, scooters, mopeds, boat motors; etc., and a wide variety of other applications such as generators, yard equipment, etc. Furthermore, the present disclosure is applicable to a wide spectrum of lubrication designs such as splash, dry or wet sump, misting, pressure-lubricated journals (conventional lubrication), etc.

Legacy two-stroke engines can be retrofitted to accommodate the present disclosure barrier apparatus and method, along with any changes in engine lubrication, and fuel delivery, while maintaining the bulk of the engine design, such as the heads, cylinder, crankshaft, etc. For example, a legacy two-stroke engine using a reed-valve to deliver air, gas, and lubricating oil to the crankcase can be adapted to the present invention by retrofitting a misting oil lubrication system, optionally locating a carburetor method of fuel delivery downstream of a barrier chamber, and/or attaching barrier chamber design between the intake and port of the engine. The present disclosure retains some advantages of current two-stroke engines, such as the ability to operate at different attitudes or orientations while providing adequate lubrication via mist lubrication, conventional lubrication with a dry sump, and to a lesser extent, lubrication with a wet sump which works best when engine is in a vertical position.

In case the increased volume caused by the barrier chamber if insufficient pressure to be developed the engine to feed the intake charge, can be compensated by modifying the piston to have a step which would increase the pumping would create supercharging.

The present invention is provided for the baseline embodiment of a single cylinder. However, the present invention is well-suited to a wide variety of engine arrangements, including multiple cylinders with each cylinder separated from the next by a baffle, or separator, that would allow the crankcase or exhaust pumping of the intake charge on a cylinder-by-cylinder basis.

While the present embodiment utilizes existing pressure in the crankcase to pump the intake charge into the combustion chamber, the present invention is well-suited to alternative methods and apparatus. For example, exhaust pressure, arising from combustion gasses escaping from the cylinder via exhaust port(s), or valve(s), into an exhaust manifold during an exhaust portion of a piston stroke, can be used to pressurize the intake charge. To separate the intake charge from the exhaust contaminants, a barrier is utilized to physically, chemically, or functionally isolate the intake charge from the air and oil mist in the crankcase or alternatively from the exhaust gases existing the cylinder. Regarding failure modes and effects analysis (FMEA), a robust feature of the present disclosure is that a failure of any barrier configuration should not cause a catastrophic failure of the engine. Rather the engine likely may operate at a reduced but sufficient performance level or possibly at an increased emission until repaired.

It should be borne in mind, however, that all of these terms are to be interpreted as referencing physical manipulations and quantities and are merely convenient labels to be interpreted further in view of terms commonly used in the art. Unless specifically stated otherwise, as apparent from the following discussions, it is understood that throughout the present disclosure, terms such as pulling, closing, generating, compressing, communicating, pumping, relieving, receiving, coupling, enabling, providing, generating, communicating, combining, performing, synchronizing, combining, or the like, refer to the action and processes of operating a fuel-powered engine, or the like, that converts fuel into mechanical motion.

While the present description provides a pressure force, such as the crankcase or exhaust pressure, to pump an intake charge into the cylinder, the present disclosure is well suited to a wide variety of driving forces such as mechanically or electrically operated devices to provide a pumping force on the intake charge while utilizing a physical, chemical, or mechanical barrier to reduce contamination of the intake charge.

In view of the embodiments described herein, the present disclosure provides various embodiments of a method, apparatus, and system that overcomes the limitations of the prior art by reducing, nominally inhibiting or reducing, substantially inhibiting or reducing, or essentially eliminating, the crankcase lubricating oil and / or crankcase and exhaust contaminants and pollutants, from entering the combustion chamber via the intake charge, while retaining two-stroke pumping action, efficiency, simplicity, low weight, and low-cost.

The foregoing descriptions of specific embodiments of the present disclosure have been presented for purposes of illustration and description. They are not intended to be exhaustive or to limit the invention to the precise forms disclosed. Many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

I claim:

1. In a two-stroke engine, a method of pumping an intake charge into a combustion chamber, the method comprising:

receiving the intake charge into a barrier chamber;

closing a check valve after the intake charge has been pulled into the barrier chamber;

pumping the intake charge from the barrier chamber into the combustion chamber of the engine using crankcase pressure without the intake charge entering the crankcase; and wherein a barrier interface having no moving substantially isolates the intake charge from contaminants in the crankcase.

2. The method of claim 1 wherein the barrier interface is a fluid trap.

3. The method of claim 1 further comprising:

generating pressure against the barrier by porting crankcase pressure to the barrier interface.

4. The engine of claim further comprising:

a piston that includes a head portion and a skirt portion, wherein a diameter of the head portion is less than a diameter of the skirt portion.

5. A fuel-powered two-stroke engine comprising:

a combustion chamber in a housing;

a crankcase coupled to the housing;

an intake coupled to the combustion chamber to receive an intake charge; and a barrier interface coupled to the housing, wherein the barrier interface pressurizes the intake charge into the cylinder using crankcase pressure without the intake charge entering the crankcase and wherein the barrier interface has no moving parts.

6. The two-stroke engine of claim 5, further comprising:

a means for pulling the intake charge into a barrier chamber using pressure from a crankcase;

means for isolating the intake charge from the contaminants in the crankcase during the pulling of the intake charge, wherein the means for isolating has no moving parts.

7. The engine of claim 5 further comprising:

a means for pumping the intake charge from a barrier chamber into an intake port of the engine using crankcase pressure; and a means for isolating the intake charge from contaminants in the crankcase during a pumping of the intake charge.

8. The engine of claim 5 wherein the barrier interface is a fluid trap.

9. The engine of claim 5 wherein the barrier interface is a filter/screen barrier that allows passage of the intake charge, but eliminates or substantially reduces passage of lubricating oil into the combustion chamber.

10. The engine of claim 5 wherein the barrier interface is a gaseous interface between the crankcase gas and the intake charge.

11. The engine of claim 10, wherein a gas in the crankcase has a specific gravity that is different from a specific gravity of the intake charge in order to segregate the crankcase and the intake charge.

12. The engine of claim 10, wherein the gaseous interface is an immiscible gas.

13. The engine of claim 5, wherein lubricating oil is eliminated from the combustion chamber.

14. The engine of claim 5, further comprising: a carburetor disposed between the barrier interface and an intake port to the cylinder.

15. The engine of claim 5, further comprising:

a means for lubricating the engine that is selected from a group comprising: splash lubricated, mist lubricated, and pressure lubricated.

16. The engine of claim 5, wherein the barrier interface and a separator wall in the crankcase is provided on a cylinder-by-cylinder basis.

17. The engine of claim 5, where:

The barrier interface is selected from one of a group of: a filter, a screen, and a filter/screen combination; and Wherein the barrier interface allows passage of the intake charger, but eliminates or substantially reduces passage of lubricating oil into the combustion chamber.

18. The engine of claim 17, wherein the barrier interface is house in a removable cartridge.

19. The engine of claim 5, wherein: the engine contains at least a portion of a legacy two-stroke design with the crankcase having lubricating oil and air that would be pumped to the combustion chamber, and the barrier interface is retrofitted to the engine.

20. A method of retrofitting a two-stroke engine comprising:

Receiving a legacy two-stroke engine designed to pump an intake charge of air from the crankcase;

Retrofitting the engine with a barrier chamber having a barrier interface, wherein the barrier interface is disposed between an intake to the engine and a port of a combustion chamber; and wherein the barrier interface pressurizes the intake charge into the combustion chamber using crankcase pressure without the intake charge entering the crankcase and wherein the barrier interface has no moving parts.

21. The method of claim 20, further comprising:

disposing a fuel delivery system downstream of the barrier chamber; and retrofitting an oil lubrication system to the crankcase.

* * * * *